United States Patent [19]

Mainberger et al.

[11] 4,265,070

[45] May 5, 1981

[54] METHOD OF AND APPARATUS FOR PACKAGING

[75] Inventors: Walter A. Mainberger; Adrian Gerritsen, both of Wayne, N.J.

[73] Assignee: Hayssen Manufacturing Company, Sheboygan, Wis.

[21] Appl. No.: 64,405

[22] Filed: Aug. 7, 1979

[51] Int. Cl.[3] ..... B65B 31/02; B65B 47/02

[52] U.S. Cl. ..... 53/433; 53/453; 53/511; 53/559

[58] Field of Search ..... 53/433, 453, 511, 559

[56] References Cited

U.S. PATENT DOCUMENTS

| | | | |
|---|---|---|---|
| 2,935,828 | 5/1960 | Mahaffy et al. | 53/511 |
| 3,343,336 | 9/1967 | Bradford | 53/559 X |

*Primary Examiner*—Travis S. McGehee

*Attorney, Agent, or Firm*—Senniger, Powers, Leavitt and Roedel

[57] ABSTRACT

A wheel-type form-fill-seal vacuum packaging machine in which a wheel carrying a circular series of dies or molds is adapted to be driven at different speeds for accommodation to different product infeed conditions, and in which a vacuum chamber/seal plate assembly is closed with respect to one of the molds with a timed dwell interval for the seal plate which is the same for different wheel speeds.

16 Claims, 7 Drawing Figures

METHOD OF AND APPARATUS FOR PACKAGING

BACKGROUND OF THE INVENTION

This invention relates to a method of and apparatus for packaging, and more particularly to a packaging method and apparatus of the form, fill and seal type.

The invention is especially concerned with a method of packaging of the type in which receptacles are formed (e.g., vacuum-formed) in a web of thermoformable flexible sheet plastic material, units to be packaged (e.g., slices of bacon on a card) are introduced one-by-one into the receptacles, and a web of thermoplastic flexible sheet plastic material is sealed to the formed web to produce hermetically sealed packages, and with a machine for carrying out the method, the machine being of the type having an endless series of dies or molds (e.g., on a wheel) in which the receptacles are formed. Reference may be made to U.S. Pat. No. 2,935,828 issued May 10, 1960 showing a prior machine of this type, the present machine involving improvements over this prior machine.

In the utilization of the continuous-motion wheel-type vacuum packaging machine, as for example in vacuum packaging bacon, the machine must generally be operated at such a speed as to accommodate what is referred to as the "instantaneous line speed" of the operation, which is the rate at which units to be packaged arrive at the machine for a short interval of time. This is distinct from the "average line speed", which has reference to the average number of units arriving to be packed in a given period of time. Generally, the machine is set to operate at a speed somewhat higher than the "instantaneous line speed" to avoid any problem of product back-up when the units are arriving at "instantaneous line speed." The problem is intensified when two supply lines are used to feed one packaging machine (e.g., when two bacon slicing lines are used to feed one packaging machine).

Provision may be made for accommodating the machine to different infeed speeds by providing it with a speed control means adapted to be set by the operator of the machine to run it at different speeds, e.g., at a high speed or a medium speed (and "stop"). Thus, the machine may have control means for running it at high speed for packaging 80 units per minute, for example, or at medium speed for packaging 60 units per minute, for example. The operator changes the speed according to her observation of the infeed of the units to the packaging machine. If units are accumulating, she sets the machine to run at high speed; if the accumulation is diminishing, she sets it to run at medium speed. If no units are coming, she stops the machine. This has advantages including enabling an operator to load units onto the infeed conveyor at a more consistent and slower pace, reducing the possibility of producing empty packages, increasing the efficiency of the packaging machine, less reworking (bad packages) and less machine maintenance.

Prior machines have been such, however, that the sealing time interval for each package (i.e., the time in which the "unformed" or "cover" web for the package is sealed to the formed web) has been inversely proportional to the speed of operation of the machine, more particularly the speed of rotation of the mold wheel. That is, in prior machines on increasing the speed of the wheel the sealing time is inherently decreased, leading to the problem that the seals on packages made at high speed may not always be satisfactory.

SUMMARY OF THE INVENTION

Accordingly, among the several objects of the invention may be noted the provision of an improved method of and apparatus for packaging of the type above described with provision for operating at different production speeds for accommodation to different infeed conditions and in which the unformed web is sealed to the formed web under generally uniform conditions regardless of the speed of operation, for consistent effective sealing of packages.

In general, in carrying out the method of this invention for packaging units in individual sealed packages, a web of thermoformable plastic material is continuously fed forward at one of different speeds. Open-mouthed receptacles are formed in the web with the receptacles spaced at intervals longitudinally of the web, portions of the web surrounding the mouths of the receptacles for the sealing thereto of a cover web in order to produce sealed packages. Units to be packaged are introduced into the receptacles, and a second web of thermoplastic material constituting a cover web is continuously fed into engagement with said portions of the first web for forward movement together with the first web. A sealing member is brought into engagement under pressure with the cover web to press it against said portions of the first web and the webs are heated where pressed together for heat-sealing them together around the open mouths of the receptacles. The sealing member is moved forward at the speed at which the web is moved forward, in unison with the webs, and the sealing member is maintained in engagement with the webs for a timed interval which is the same for the different speeds and then withdrawn from the webs.

In general, the apparatus of this invention comprises means for continuously feeding forward a web of thermoformable plastic material and forming open-mouthed receptacles in the web with the receptacles spaced at intervals longitudinally of the web and with portions of the web surrounding the mouths of the receptacles for the sealing thereto of a cover web for forming sealed packages, said means being operable at one of different speeds. Units to be packaged are introduced into said receptacles. Means is provided for continuously feeding a second web of thermoplastic material constituting a cover web into engagement with said portions of the first web for forward movement together with the first web. The apparatus further comprises a sealing member and means for bringing it into engagement under pressure with the cover web to press it against said portions of the first web and heating said webs where pressed together for heat-sealing them together around the open mouths of the receptacles, means for moving the sealing member forward at the speed at which the web is fed forward, and means for maintaining the sealing member in engagement with the webs for a timed sealing interval which is the same for the different speeds of the web and then withdrawing the sealing member from the webs.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
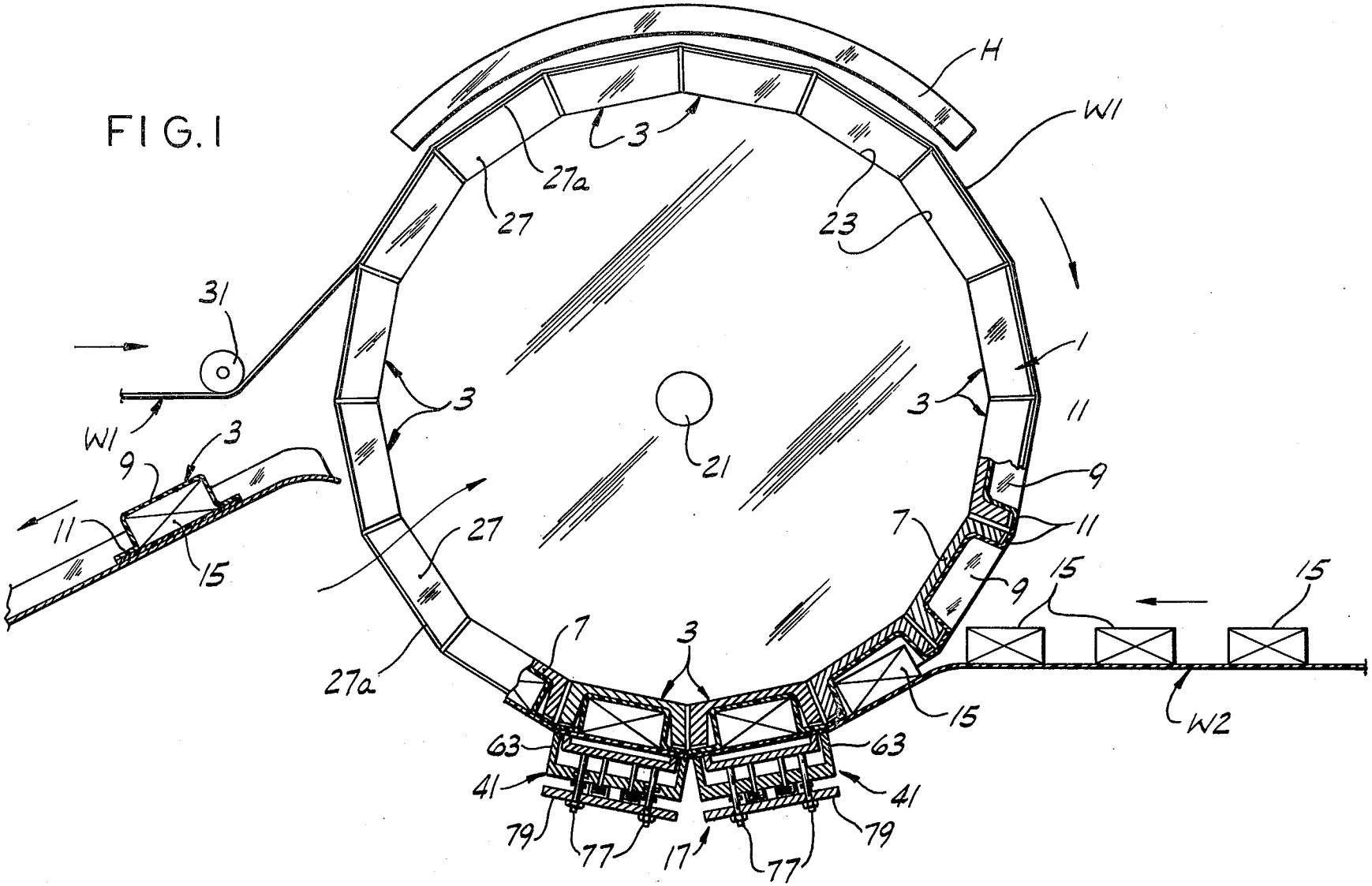
FIG. 1 is a view in side elevation, with parts broken away and shown in section, of a wheel with a series of molds thereon and two vacuum chamber/seal plate assemblies for evacuating and sealing packages, and showing a web being fed around the wheel, receptacles formed in the web in the cavities in the molds, a cover web being fed toward the bottom of the wheel with units of product thereon, the units being introduced into the receptacles and the cover web being sealed to the first web, completed packages being discharged at approximately the nine o'clock position of the wheel.

Referring to the drawings, packaging apparatus of this invention is shown to comprise an endless series 1 of molds 3 (see FIGS. 1 and 2), the series being movable to move the molds around in an endless path, and means indicated generally at 5 (see FIG. 3) for driving the series continuously to move the molds around in said endless path at different speeds. Each mold 3 has at least one cavity 7 therein. A web W1 of thermoformable flexible sheet plastic material, e.g., polyethylene film, is fed continuously toward the series 1 of molds for forming open-mouthed receptacles 9 in the web in the mold cavities 7 with the receptacles spaced at equal intervals longitudinally of the web and with flange or rim portions 11 of the web on the rims 13 of the molds surrounding the mouths of the receptacles. Units 15 to be packaged, each of which may comprise a single entity or a plurality of entities (such as a plurality of slices of bacon on a card), are introduced into the receptacles. A second web W2 of thermoplastic flexible sheet plastic material, (e.g., polyethylene-coated nylon) is fed toward the first web W1 and the endless series 1 of molds 3 for being sealed to portions 11 of the first web for forming hermetically sealed packages P. At 17 is generally indicated means for sealing the second web W2 to the portions 11 of the first web W1 surrounding the mouths of the receptacles 9 in the first web for forming the hermetically sealed packages P. As will appear, the sealing means 17 may be associated with means for evacuating the packages before the web W2 is sealed to the web W1, for the vacuum packaging of the units 15.

As herein illustrated, the molds 3 are mounted on the periphery or rim of a wheel or drum 19 mounted for rotation on a horizontal shaft 21. The rim, instead of being circular at its outer periphery or circumstances, is of regular polygonal form, having a plurality of flat faces such as indicated at 23. Each of these flat peripheral faces 23 of the rim of the wheel is of rectangular shape in plan, all being of the same size. The molds 3 are rectangular in plan, each having at least one of the cavities 7 therein in the shape of the receptacles 9 to be formed in the web W1. As shown, each mold has a bottom 25, end walls 27 (extending in machine direction) and transverse walls 29 (extending in across-the-machine direction) defining a single cavity 7. Each mold is flat at its outside face, i.e., at the face defined by the rim 13 of the mold, these flat outside faces of the molds being in planes parallel to the respective faces 23 of the rim of the wheel. The edges of walls 27 and 29 have resilient sealing strips 27*a* and 29*a*, (e.g., silicone rubber strips) thereon as in U.S. Pat. No. 2,935,828. The molds may have more than one cavity; for example, they may have two equal-sized cavities side-by-side for forming two receptacles at a time per mold. Or they may have more than two cavities side-by-side, and may even have two or more rows of cavities with two or more cavities side-by-side in each row.

The wheel 19 and the molds 3 as above described are the same or generally the same as disclosed in U.S. Pat. No. 2,935,828, with provision for drawing a vacuum in the cavity of each mold generally the same as disclosed in said patent. The web W1 is fed to the wheel in the same or generally the same manner as disclosed in said patent, being trained around the top of the wheel, and being heated in the same or generally the same manner as disclosed in said patent, the heating means being indicated generally at H in FIGS. 1 and 2, for the vacuum-forming of the receptacles 9 in the web W1 as it travels around with the wheel. The web W1 is clamped at its margins on the outside of the molds, i.e., on the rims of the molds at the sides of the molds by means of clamps 30 in the same or generally the same manner as in U.S. Pat. No. 2,935,828 for gripping the web for rotation with the wheel and holding it in sealed engagement with the sealing strips 27*a* on the end walls 27 of the mold for the vacuum forming operation. Reference may be made to U.S. Pat. No. 2,935,828 for details of a suitable web feeding and heating means, vacuum-forming system, and web-clamping means.

As illustrated in FIG. 1, the web W1 is fed toward the wheel 19 from a supply roll (not shown), under a web guide roller 31 (corresponding to that illustrated at 24 in U.S. Pat. No. 2,935,828) at one side of the wheel (its left side as appears in FIG. 1), up and around the wheel in clockwise direction as appears in FIG. 1 and back toward the left on the bottom of the wheel. With the web W1 clamped to the wheel, it travels around clockwise with the wheel. As it travels around with the wheel through a zone at the top of the wheel, it travels under the heating means H for heating the web for the vacuum forming of the receptacles in the web in the mold cavities 7. These receptacles are cooled via a cooling water system such as disclosed in U.S. Pat. No. 2,935,828 as they travel around with the wheel (clockwise as viewed in FIG. 1), being completely formed, cooled and set by the time they approach the bottom of their circular path of travel with the wheel.

The second web W2 (the cover web) is fed toward the bottom of the wheel from the right as viewed in FIG. 1 in what is in effect upside-down relation, carrying on the top units 15 to be packaged, with the units spaced at intervals longitudinally of the web W2 corresponding to the spacing of the receptacles 9 in the mold cavities 7 on the wheel, and with the units 15 in such phase with respect to the receptacles as to be introduced into the receptacles while on the web W2 at the bottom of the wheel, the web W2 engaging the receptacle rim portions 11 of the web W1 surrounding the mouths of the receptacles.

Figure 4:
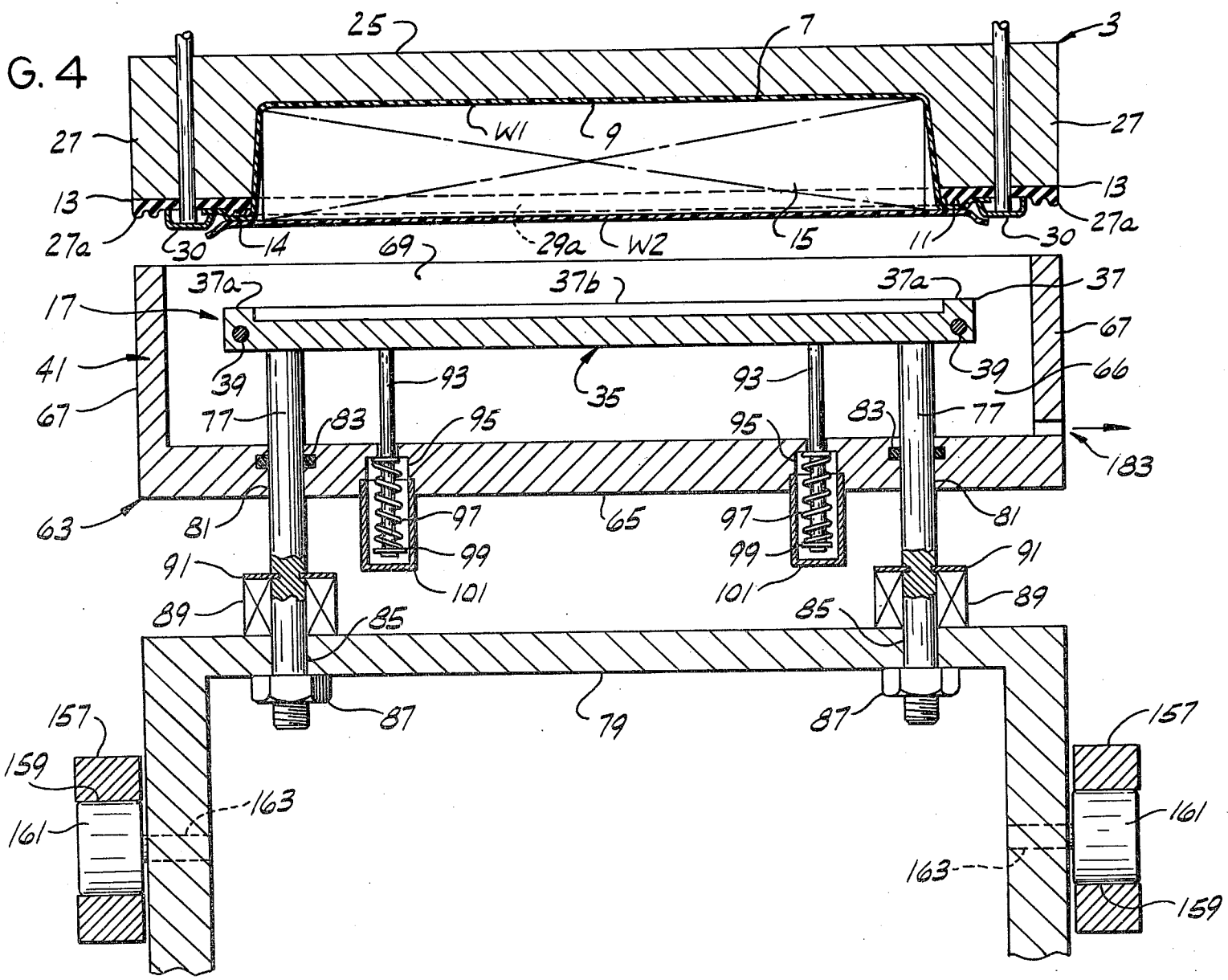
FIG. 4 is a schematic view of a vacuum chamber/seal plate assembly of the apparatus with parts in section on various planes.

The web W2 is heat-sealed to two adjacent receptacles 9 at a time (having brought units 15 into these two receptacles) by the sealing means indicated generally at 17, the latter comprising two sealing members each designated 35 adapted for engagement under pressure with the cover web W2 to press it together with the rim portions of the first web W1 against the sealing strips 27*a*, 29*a* on the rim of a respective mold. Each sealing member comprises a rectangular plate having an upwardly extending peripheral flange 37 for engagement with the web W2 to press it against the rim portions 11 of the web W1 surrounding the mouth of the receptacle 9 formed in the web W1 (and now containing a unit 15), and to press web W2 and the rim portions against the sealing strips on the mold. The seal plate 35 has electrical heating elements therein as indicated at 39 for heating it to effect the heat sealing of the cover web W2 to the rim portions 11 of web W1 surrounding the mouth of receptacle 9 by application of heat and pressure. The webs W1 and W2 are generally of equal width, with their width less than the distance between the ends of the mold 3 but greater than the distance between the ends of the cavity 7 in the mold. Web W1 is guided onto the wheel in centered relation with respect to the molds 3. Thus, the margins of the web W1 overlie the inner margins of the sealing strips 27*a* at the ends of the molds 3, but are clear of the outer margins of the sealing strips 27*a*. Web W2 may be registered with web W1. The seal plate 35 is dimensioned for engagement of the end portions 37*a* of its flange 37 with the web W2 on the inside of the clamps 30 (see FIG. 4) along the inner margins of strips 27*a*, and for engagement of the across-the-machine portions 37*b* of flange 37 with the web W2 along the inner margins of strips 29*a*.

Figure 2:
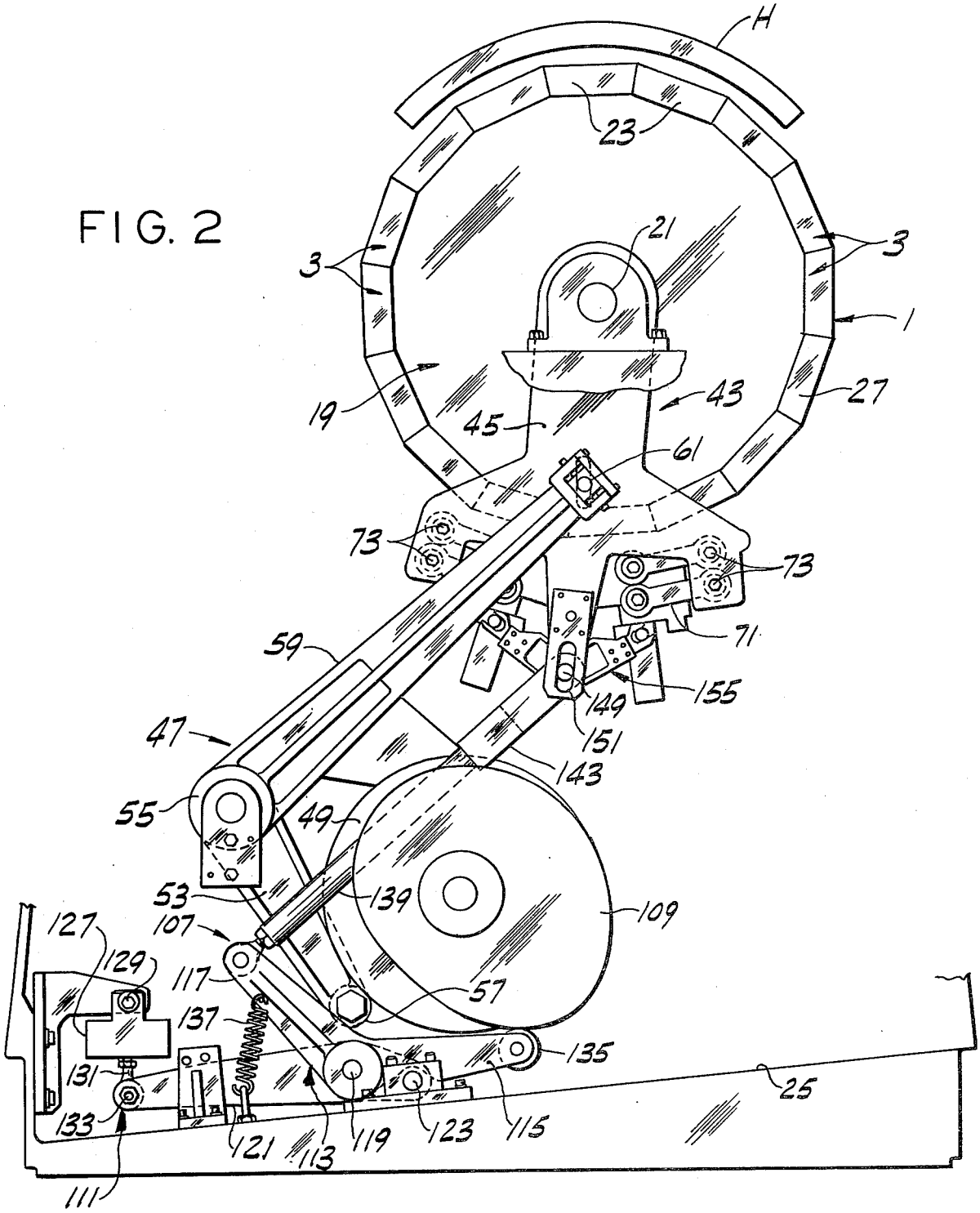
FIG. 2 is a view in side elevation on a smaller scale than FIG. 1 of the wheel and mechanism associated therewith.
Figure 3:
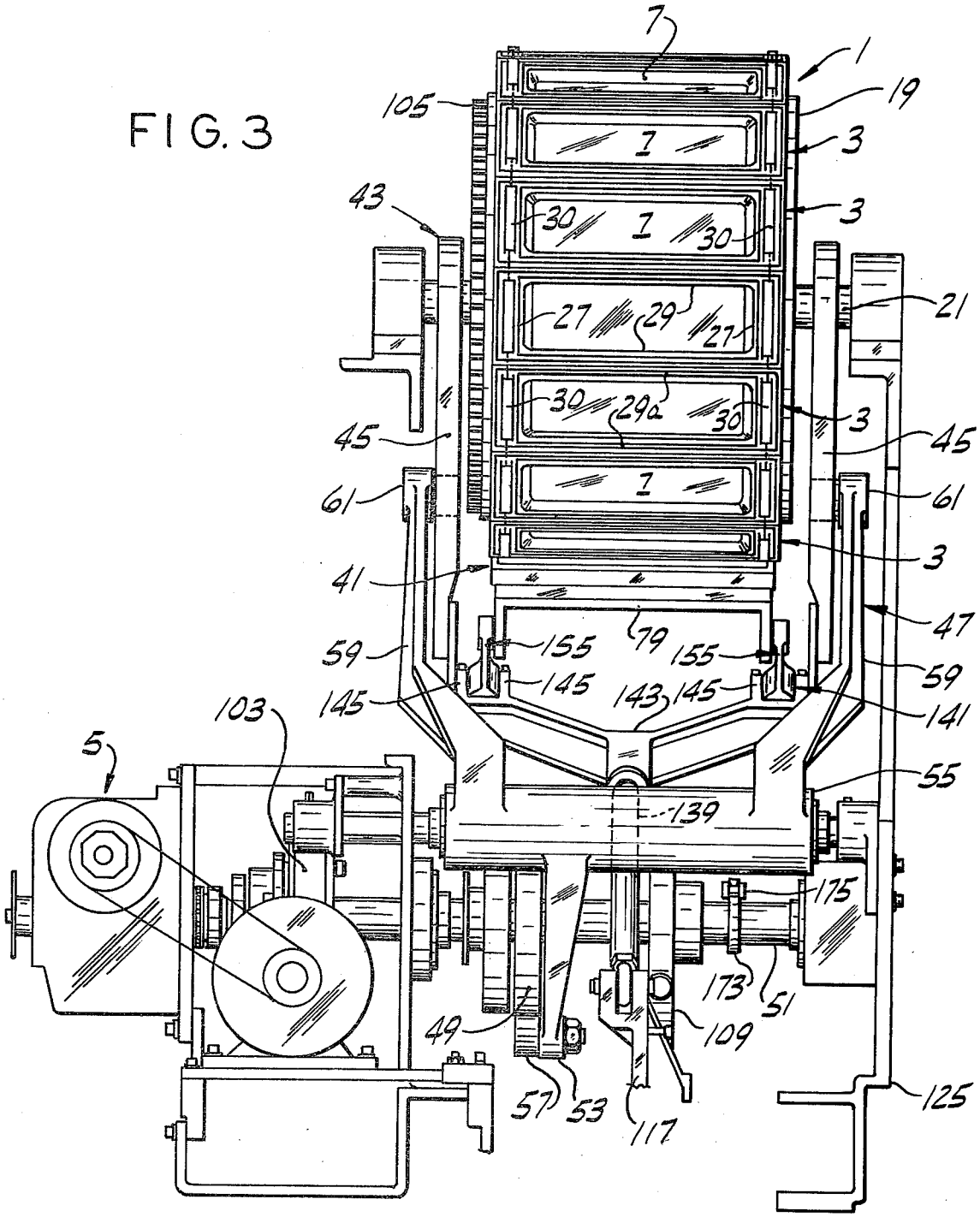
FIG. 3 is a view in elevation of the FIG. 2 apparatus from the left of FIG. 2, parts being broken away.

Each seal plate 35 is included in a vacuum chamber/-seal plate assembly designated in its entirety by the reference numeral 14. There are two of these assemblies (see FIG. 1), one leading and one trailing in respect to the direction of travel of the packages, for forming two vacuum packages at a time as aforesaid. Both assemblies are carried by a carrier or rocker arm assembly generally designated 43 mounted for oscillatory movement in unison with the series of molds 3 on the wheel 19 through a forward stroke (i.e., in clockwise direction as viewed in FIG. 2) from an initial position (in which the carrier is shown in FIG. 2) to an advanced position, and for movement in reverse direction (counterclockwise as viewed in FIG. 2) through a return stroke back to the initial position. The carrier 43 generally comprises a pair of rocker arms 45 pivoted for swinging movement on the shaft 21 at opposite sides of the wheel 19. The arms are operated in unison by the dual arms of rocker arm means 59.

Means indicated generally at 47 is provided for swinging the carrier 43 through a forward stroke at the same speed as the wheel 19 and immediately bringing the carrier back through a return stroke at relatively high speed (i.e., with quick-return of the carrier). As shown, this means comprises a conjugate cam 49 on a shaft 51, a follower arm 53 on a rocker shaft 55 carrying cam follower roller 57 in engagement with the cam, and a rocker arm means 59 with arms at opposite sides of the wheel suitably connected at 61 to the carrier arms 45. The shaft 51 is driven by the drive means 5 for the wheel so that cam 49 is driven in timed relation with the wheel. The cam 49 is so developed and phased with respect to the wheel as to cause the carrier 43 to swing forward (clockwise) from its initial position in unison with the wheel through the stated forward stroke of the carrier, and then to effect quick-return of the carrier back to its initial position.

Each vacuum chamber/seal plate assembly 41 comprises a rectangular box having a bottom 65 and four walls defining a vacuum chamber 63. Two opposite walls of the chamber, each designated 67, extend in the direction of travel of the molds (i.e., in machine direction) and constitute its end walls; the other two opposite walls, each designated 69, extend transversely with respect to the direction of travel of the molds (i.e., in across-the-machine direction). The chamber is open at the top. The upper edges of its end walls 67 are engageable with the sealing strips 27*a* on the outside of the clamps 30 at the ends of a mold 3 to seal against the outer margins of the sealing strips 27*a*, and the upper edges of its transverse walls 69 are engageable with web W2 to press it together with web W1 against the outer margin of the sealing strips 29*a* on the transverse walls 29 of the mold.

Each vacuum chamber 63 is mounted on the carrier 43 for movement toward and away from the molds 3 on the wheel 19 by means of a pair of links each designated 71 at one side of the carrier and a corresponding pair of links at the other side. Each of these links 71 is pivoted at one end as indicated at 73 on the respective rocker arm 45 of the carrier and has a pivotal connection at its other end as indicated at 75 with the respective end of the vacuum chamber. Each of the two vacuum chambers extends between the respective pair of links 71 on the rocker arm 45 at one side of the wheel and the respective pair of links on the rocker arm at the other side of the wheel, the two pairs of links mounting the chamber for movement relative to the carrier 43 between a retracted (lowered) open position clear of the molds 3 on the wheel and a raised closed position wherein the upper edges of the end walls 67 of the box seal against the outer margins of the sealing strips 27*a* on the end walls 27 of a mold and against web W2 along the outer margins of sealing strips 29*a* on the transverse walls 29 of the mold.

Each seal plate 35 is movable up and down with the respective vacuum chamber 63, and also movable up and down relative to the respective vacuum chamber, being mounted on the upper ends of rods 77 which extend up from a yoke 79 below the chamber through holes 81 in the bottom of the chamber, the rods being slidable in these holes. Two rods 77 are used for each chamber. Seals are provided for the rods as indicated at 83. The rods are movable up and down with the yoke and also movable relative to the yoke, being yieldably mounted with respect to the yoke by being slidable up and down in holes 85 in the yoke, with upward movement of the rods in the yoke being limited by the engagement of nuts 87 threaded on the lower ends of the rods with the bottom of the yoke, Belleville washers 89 being provided between a collar 91 on each rod 77 and the top of the yoke. Smaller rods 93 extend down from the seal plate 35 through holes 95 in the bottom 65 of the vacuum chamber 63, the rods being slidable in these holes. Four rods 93 are used per chamber. Coil compression springs 97 surrounding rods 93 reacting from the bottom of the chamber against heads 99 at the lower ends of the rods bias the seal plate 35 downwardly relative to the chamber to the lowered retracted position of the seal plate shown in FIG. 4 in which the upper edge of the flange 37 of the plate 35 is below (e.g., 0.30" below) the upper edge of the chamber 63. Housings such as indicated at 101 may be provided for the springs 97.

The drive means 5 includes means for driving the shaft 51 at different speeds, under control of the operator of the machine, and comprises a pulley and timing belt drive including a pulley 103 on shaft 51 driving the wheel 19 via gearing including a large anti backlash pinion gear 105 on the wheel. With the wheel driven from shaft 51 and cam 49 on this shaft, cam 49 is driven in timed relation with the wheel.

Figure 5:
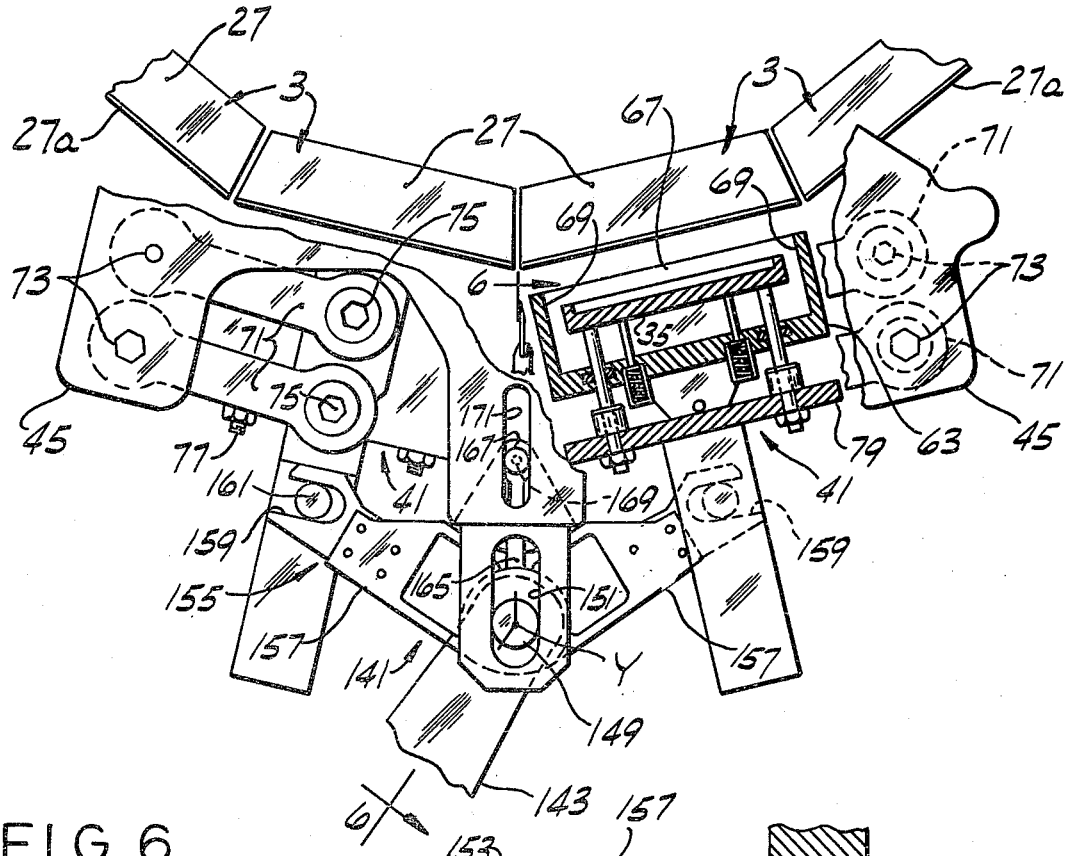
FIG. 5 is an enlarged fragment of FIG. 2, with parts broken away and shown in section, showing the vacuum chamber/seal plate assemblies of the apparatus.

There being two vacuum chamber/seal plate assemblies 41, there are two yokes 79, one for each of the vacuum chambers 63 of the two assemblies. Means indicated generally at 107 and comprising a cam 109 on shaft 51 is provided for moving the yokes 79 and hence the assemblies 41 upwardly in unison from the lowered retracted position in which they appear in FIG. 5, wherein they are below and clear of the wheel 19, to the raised position in which they appear in FIG. 1 wherein they are closed with respect to two adjacent molds 3 on the wheel. Cam 109, being on shaft 51, is driven in timed relation with respect to the wheel and in timed relation with respect to cam 49 for oscillating the carrier 43. The assemblies 41 first move toward the molds 3 on the wheel and chamber 63 touches the mold and seals against outer seal 27A. At this point air is withdrawn from the chambers 63 and receptacle 9 through a valve. The assembly 41 moves in synchronization with the wheel for a fixed distance, after which the seal plate 35 is moved relative to the chamber by a further rise of cam 109 until it seals against the package flanges 11 backed by inner seal 27A. The dwell of the seal plate 35 against the receptacle flanges 11 is timed independently of cam 109 by means indicated generally at 11 as will appear. Soon after the seal is made, the entire chamber assembly 41 is vented and moved to its retracted position away from the wheel 19 and returned to its initial starting point.

Figure 6:
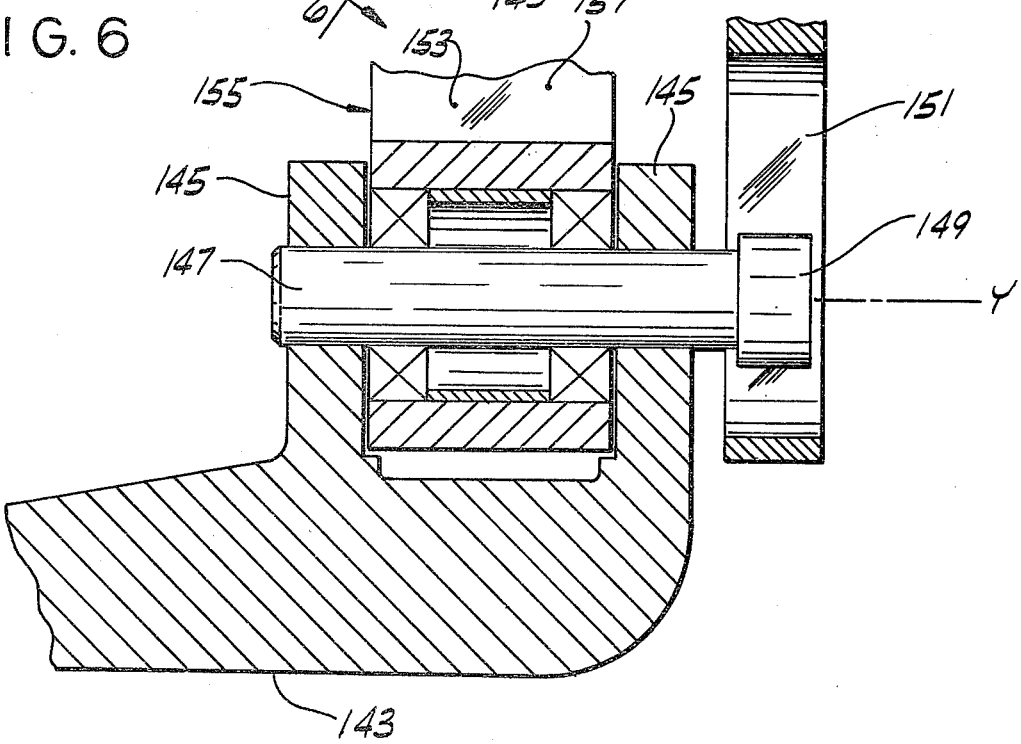
FIG. 6 is a section on line 6—6 of FIG. 5.

The means 107 for moving the yokes 79 and hence the vacuum chamber/seal plate assemblies 41 up and down comprises a bell crank lever 113, the two arms of which are designated 115 and 117, pivoted at 119 on an axis parallel to the axis of shaft 51 on a pivot shift arm or yoke 121. This yoke 121 is pivoted at 123 on the frame 125 of the machine for swinging movement on an axis parallel to the axis of shaft 51, being swingable by means of an air cylinder 127 between the raised position in which it is illustrated in solid lines in FIGS. 2 and 7 and the lowered position in which it is illustrated in phantom in FIG. 7 to shift the pivot 119 between the raised position indicated at R in FIG. 7 and the lowered position indicated at L in FIG. 7. The air cylinder 127 is a short-stroke cylinder pivoted at 129 on the frame of the machine; its piston rod 131 extends down from its piston 132 to a pin-connection at 133 to the free end of the yoke 121. The yoke 121 and air cylinder 127 are components of the timing means 111. Arm 115 of the bell crank 113 carries a cam follower roller 135. A spring 137 connected to arm 117 of the bell crank biases it to swing counterclockwise as viewed in FIG. 2 for engagement of roller 135 with the cam 109. A rod 139 interconnects arm 117 of the bell crank 113 and actuator means 141 associated with the carrier 43, this actuator means being movable up and down relative to the carrier and swingable relative to the carrier on an axis Y extending in across-the-machine direction. The actuator means 141 comprises a crosshead 143 at the upper end of the connecting rod 139 extending in across-the-machine direction and having a pair of lugs 145 at each of its ends receiving pins 147 extending on the axis Y (see particularly FIG. 6). These pins have rollers 149 at their outer ends movable up and down in slots 151 in the carrier arms 45 adjacent the lower ends of these arms. Each of the pins 147 (at opposite ends of the crosshead and hence toward opposite sides of the machine) has the hub 153 of a yoke shifter 155 pivoted therein between the two lugs 145 of the respective pair. Each yoke shifter 155 has arms 157 extending radially outwardly from its hub 153 in a V-formation. These yokes shifters 155 straddle the yokes 79 for the two vacuum chamber/seal plate assemblies 41. Each yoke shifter arm 157 has a slot 159 at its outer (upper) end receiving a roller 161 on a pin 163 extending laterally outwardly from the respective side of the respective yoke. Each yoke shifter 155 also has an upwardly extending central arm 165 (bisecting the V), each of these arms 165 having a roller 167 on a pin 169 extending laterally outwardly from the arm 165 movable up and down in a slot 171 in the respective carrier arm 45 in line with and above the slot 151 in the respective arm 45. In this manner, the yoke shifters 155 are movable up and down relative to the carriers 43 to move the yokes 79 and hence assemblies 41 up and down, while allowing for pivoting of the crosshead 143 relative to the yoke shifters 155 on the axis Y of pins 147.

Figure 7:
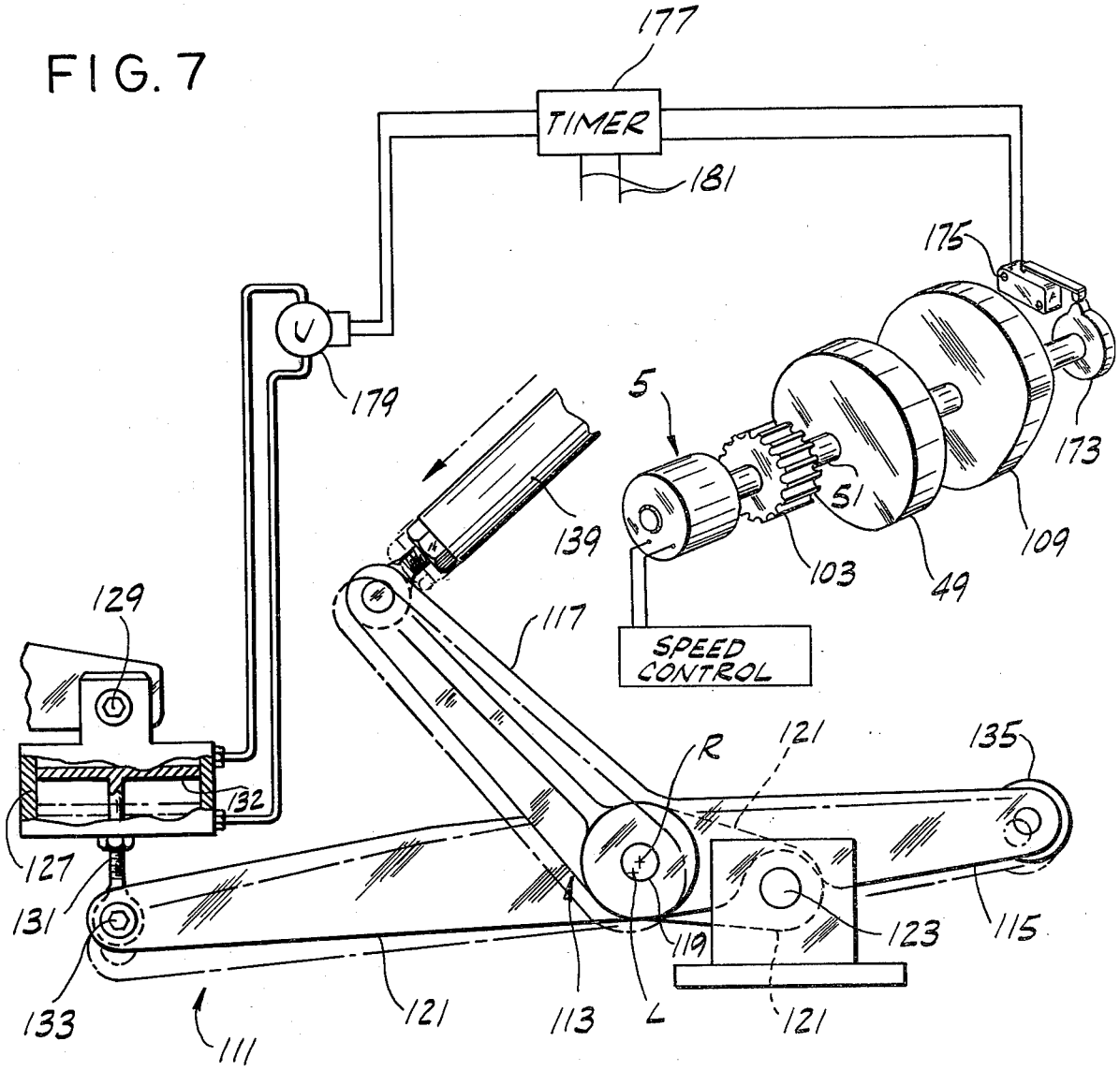
FIG. 7 is a view showing means of the apparatus for timing the operation of sealing the cover web to the formed web.

Referring now more particularly to FIG. 7, the means 111 for timing the interval in which the seal plate 41 dwells in closed position on the receptacle flange 11 comprises, in addition to the pivot shift yoke 121 and the air cylinder 127, means comprising a cam 173 on shaft 51 for actuating a switch 175 to transmit a signal at the instant the seal plates 35 contact the web W2 on the outside faces of the two molds 3, and a timer 177 activated by the signal and controlling a solenoid valve 179 for controlling the operation of the air cylinder. A power supply line for the timer is indicated at 181. The timer functions, on receiving the signal that the seal plates have closed, to time out the dwell interval for the seal plates, transmitting a signal to the valve 179 at the termination of the timed dwell interval to shift to supply air to the upper end of cylinder 127 and vent its lower end to drive the piston 132 and piston rod 131 of the cylinder down to shift the bell crank pivot 119 from position R to L. Having timed out the seal plate dwell interval, the timer resets for the next cycle and resets valve 179 to shift the bell crank pivot 119 back up to position R.

Operation is as follows:

The apparatus may be regarded as operable in successive cycles each involving a single revolution of the shaft 51 for a single revolution of each of the cams 49, 109 and 173, and a fraction of a revolution of the wheel 19, this fraction corresponding generally to the ratio of the number of degrees of arc subtended by two adjacent molds 3° to 360°. At the start of a cycle, the piston 132 and piston rod 131 of air cylinder 127 are up and the pivot shifter yoke 121 accordingly occupies its raised position, pivot 119 thereby occupying its raised position R. Yokes 79 of the vacuum chamber/seal plate assemblies 41 are down and hence these assemblies are down in their open position (see FIGS. 4 and 5). As the cam 49 on shaft 51 rotates in timed relation with the wheel 19 from its 0° position through a revolution, it acts (via follower arm 53 and arms 59) to swing the carrier 43 forward (clockwise) in unison with the wheel through the forward stroke of the carrier (corresponding to the stated fraction of a revolution of the wheel), and then to swing the carrier back to its starting position.

The vacuum chamber/seal plate assemblies 41 move forward with the carrier and, as they start their forward movement, cam 109 on shaft 51 acts via its bell crank follower member 113, connecting rod 139 and crosshead 143, and yoke shifters 155 to shift yokes 79 upwardly relative to the carrier rocker arms 45, rollers 149 and 167 riding up in slots 151 and 171. On the upward movement of the yokes 79, the rods 77 of each assembly 41 move up and act through the respective seal plate 35, rods 93, heads 99 and springs 97 to raise the respective vacuum chamber 63 for pressurized engagement of the upper edges of walls 67 and 69 of the chamber with the outer margins of the sealing strips 27*a*, 29*a* at the rim 13 of a respective mold 3. This seals chamber interior 66 from the atmosphere, and with a vacuum drawn therein similar to that disclosed in U.S. Pat. No. 2,935,828, and as indicated at 183 in FIG. 4, the respective package within the chamber is evacuated, air being drawn out of the package between the margins of the webs W1 and W2 at the ends of the mold 3, these margins being unsealed with the margins of W2 free of the margins 11 of W1 at the ends of the mold at this time.

With continued upward movement of the yokes 79, the force of springs 97 is overcome, and the seal plate 35 of each assembly 41 is moved up in chamber 66 relative to the chamber 63 for pressurized engagement of the upper edges of portions 37*a* and 37*b* of the flange 37 of the seal plate with web W2 to press webs W2 and W1 together against the inner margins of the sealing strips 27*a* and 29*a*. With the flange 37 heated by heating elements 39, the webs W2 and W1 are heatsealed together, all around the mouth of the receptacle 9 in the respective mold 3. The Belleville washers 89 allow for some upward movement of yoke 79 after the seal plate 35 has completed its movement to closed position, and are compressed for spring-pressurized engagement of the flange 37 of the seal plate with the webs W2 and W1.

When the seal plates 35 move upwardly to their closed position, cam 173 actuates switch 175 to transmit a signal to the timer 177 that the seal plates have closed. The timer 177 then times out a dwell interval for the seal plates sufficient (taking into account the sealing pressure of the seal plates and the sealing temperature of the seal plates) for forming an effective seal between the webs at 11 around the mouths of the receptacles. At the end of this dwell interval, the timer 177 signals the valve 179 to shift to position for driving the piston 132 and piston rod 131 of cylinder 127 down to shift the pivot shift yoke 121 down. This downshift of the yoke 121 carries the pivot 119 down and results in downshift of the connecting rod 139 and its crosshead 143 to downshift the yoke shifters 155, thereby downshifting the seal plate 35 to open position to terminate the sealing operation. The chamber is then vented and assembly 41 retracts through action of cam 109. The timer then resets and effects resetting of the valve 179 to drive piston 132 and piston rod 131 of cylinder back up to raised position to return the pivot shift yoke 121 to raised position for the next cycle and the carrier 43 and assembly 41 return to their initial position and complete the cycle.

It will be observed that the dwell time of the seal plates 35 in their closed (sealing) position is determined by the timer 177 independently of the cam 109 for the vacuum chamber/seal plate assemblies 41. Thus, the cover (unformed) web W2 is sealed to the formed web W1 under generally uniform conditions of time as well as temperature and pressure regardless of the speed of operations, as determined by the speed of the wheel 19 (which determines the number of cycles of operation per minute). This enables the operator to change the speed of operation of the wheel 19, e.g., from a speed of 80 packages per minute to 60 packages per minute and vice versa, according to her observation of the delivery of units 15 to the vicinity of the web W2 for placement by the operator on web W2 for being fed forward by web W2. Whatever speed she sets, the sealing time remains the same. It will be understood that the sealing time, i.e., the dwell time of seal plates 35 in sealing position, will always be set (by appropriate setting of the timer 177) to be the same as or less than what the dwell time would be under circumstances of operation of the machine at maximum speed with control of the dwell time solely by the cam 109 on shaft 51. Under the latter circumstances, the dwell time would be different for different speeds of the cam and hence different for different speeds of the wheel 19 (lower for higher speeds and vice versa).

Generally, in the operation of the apparatus, units 15 to be packaged are delivered via an infeed conveyor (not shown, corresponding to conveyor 2 shown in U.S. Pat. No. 2,935,828) to the cover web W2 for being fed forward on the cover web into the apparatus, unit arriving at the infeed conveyor from one or more supply lines, being loaded onto the infeed conveyor by the operator of the apparatus. If the delivery of units by the supply line or lines is relatively fast and causes an accumulation of units at the infeed, the operator increases the speed of the wheel 19, thereby increasing the speed of the webs W1 and W2 (and also the speed of the infeed conveyor) to enable faster packaging to reduce the accumulation. And as the accumulation diminishes, the operator may decrease the speed of the wheel, thereby decreasing the speed of the webs and the infeed conveyor to keep pace. Whatever the speed of the wheel, the seal time remains the same, and since the seal temperature and seal pressure remain the same, the package seals are uniformly effective.

The vacuum chamber/seal plate assemblies 41 may include a suitable cutter or knife as in U.S. Pat. No. 2,935,828 for cutting the webs W1 and W2 between successive packages, accounting for the showing in FIG. 1 of individual separated packages sliding down out of the apparatus at the lower left.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of packaging units in individual sealed packages comprising:

continuously feeding forward a web of thermoformable plastic material at one of different speeds;

forming open-mouthed receptacles in the web with the receptacles spaced at intervals longitudinally of the web and with portions of the web surrounding the mouths of the receptacles for the sealing thereto of a cover web for forming sealed packages;

introducing units to be packaged into said receptacles;

continuously feeding a second web of thermoplastic material constituting a cover web into engagement with said portions of the first web for forward movement together with the first web;

bringing a sealing member into engagement under pressure with the cover web to press it against said portions of the first web and heating said webs where pressed together for heat-sealing them together around the open mouths of the receptacles;

moving the sealing member forward at the speed at which the web is fed forward; and maintaining the sealing member is engagement with the webs for a timed sealing interval which is the same for the different speeds of the web and then withdrawing the sealing member from the webs.

2. The method of claim 1 wherein the first web is fed forward in a predetermined path with the mouths of the receptacles directed downward, the second web is fed into engagement with the first, and the units to be packaged are fed forward on the second web for entry into the receptacles, the first web being fed forward at a speed as determined by the delivery of units for being fed forward on the second web.

3. Packaging apparatus comprising:

an endless series of molds each having a cavity therein, said series being movable to move the molds around in an endless path;

means for continuously driving said series to move the molds around in said path and operable for driving the series at different speeds;

a first web of thermoformable sheet material being fed toward said series for forming open-mouthed receptacles in said web in the mold cavities with the receptacles spaced at intervals longitudinally of the web and with portions of the web surrounding the mouths of the receptacles for the sealing thereto of a cover web for forming sealed packages, units to be packaged being introduced into said receptacles;

a second web of flexible sheet material constituting a cover web being fed toward said first web and said series for being sealed to said portions of the first web for forming the sealed packages;

means for sealing the second web to the portions of the first web surrounding the mouths of the receptacles comprising a sealing member for engagement under pressure with the cover web to press it together with said portions of the first web against a mold;

a carrier for the sealing member mounted for movement in unison with the series through a forward stroke from an initial position and for movement in reverse direction through a return stroke back to initial position;

said sealing member being carried by the carrier for movement relative to the carrier from a retracted position relative to the molds to a sealing position in pressurized engagement with the second web for pressing the latter together with said portions of the first web against a mold;

means for moving the carrier through its forward stroke at the same speed as said series for any speed of the series and for moving it back through its return stroke to its initial position;

means comprising a cam driven in timed relation with said series for moving the sealing member to its sealing position on the forward stroke of said carrier, the sealing member then dwelling in sealing position for a dwell interval; and means operable independently of the cam for timing the dwell of the sealing member in its sealing position.

4. Packaging apparatus as set forth in claim 3 wherein the means for moving said sealing member comprises a cam follower member and means interconnecting said cam follower member and said sealing member, and wherein said timing means comprises means for moving said cam follower member independently of the cam a predetermined time interval after the sealing member has moved to sealing position for retracting the sealing member.

5. Packaging apparatus as set forth in claim 4 wherein the cam follower member is a lever, wherein a pivot is provided for the lever, and wherein said timing means comprises means mounting the pivot for movement between a first position wherein the cam is operable via the lever to move the sealing member to its sealing position and hold it there for said dwell interval and a second position for retracting the sealing member, and said moving means is operable to move the pivot to its said second position on elapse of said predetermined time interval.

6. Packaging apparatus as set forth in claim 3 wherein said endless series of molds is a circular series on a wheel, the means for continuously driving said series comprising means for driving the wheel at different speeds, the first web is fed around the top of the wheel and proceeds around with the wheel to the bottom of the wheel where the mouths of the receptacles formed in the first web are directed downward, the second web is fed into engagement with the first at the bottom of the wheel, and the units to be packaged are fed forward on the second web for entry into the receptacles, the carrier is oscillable on the wheel axis, and wherein the cam is driven by the means for driving the wheel, and the means for driving the wheel is adapted to drive it at different speeds as determined by the delivery of units for being fed forward on the second web.

7. Packaging apparatus as set forth in claim 6 wherein the means for moving said sealing member comprises a cam follower member and means interconnecting said cam follower member and said sealing member, and wherein said timing means comprises means for moving said cam follower member independently of the cam a predetermined time interval after the sealing member has moved to sealing position for retracting the sealing member.

8. Packaging apparatus as set forth in claim 7 wherein the cam follower member is a lever, wherein a pivot is provided for the lever, and wherein said timing means comprises means mounting the pivot for movement between a first position wherein the cam is operable via the lever to move the sealing member to its sealing position and hold it there for said dwell interval and a second position for retracting the sealing member, and said moving means is operable to move the pivot to its said second position on elapse of said predetermined time interval.

9. Packaging apparatus as set forth in claim 3 having means defining a vacuum chamber associated with the sealing member, the cam being operable to move the vacuum chamber means into engagement with a mold for evacuating a package being formed before the sealing member reaches its sealing position.

10. Packaging apparatus as set forth in claim 9 having a cam follower member operable by the cam and means interconnecting said cam follower member and vacuum chamber means and sealing member, and wherein said timing means comprises means for moving said cam follower member independently of the cam a predetermined time interval after the sealing member has moved to sealing position for retracting the sealing member.

11. Packaging apparatus as set forth in claim 10 wherein the cam follower member is a lever, wherein a pivot is provided for the lever, and wherein said timing means comprises means mounting the pivot of movement between a first position wherein the cam is operable via the lever to move the vacuum chamber means into engagement with a mold and to move the sealing member to its sealing position and hold it there for said dwell interval and a second position for retracting and sealing member and said moving means is operable to move the pivot to its said second position on elapse of said predetermined time interval.

12. Packaging apparatus as set forth in claim 9 wherein said endless series of molds is a circular series on a wheel, the means for continuously driving said series comprising means for driving the wheel at different speeds, the first web is fed around the top of the wheel and proceeds around with the wheel to the bottom of the wheel where the mouths of the receptacles formed in the first web are directed downward, the second web is fed into engagement with the first at the bottom of the wheel, and the units to be packaged are fed forward on the second web for entry into the receptacles, the carrier is oscillable on the wheel axis, and wherein the cam is driven by the means for driving the wheel, and the means for driving the wheel is adapted to drive it at different speeds as determined by the delivery of units for being fed forward on the second web.

13. Packaging apparatus as set forth in claim 12 having a cam follower member operable by the cam and means interconnecting said cam follower member and vacuum chamber means and sealing member, and wherein said timing means comprises means for moving said cam follower member independently of the cam a predetermined time interval after the sealing member has moved to sealing position for retracting the sealing member.

14. Packaging apparatus as set forth in claim 13 wherein the cam follower member is a lever, wherein a pivot is provided for the lever, and wherein said timing means comprises means mounting the pivot for movement between a first position wherein the cam is operable via the lever to move the vacuum chamber means into engagement with a mold and to move the sealing member to its sealing position and hold it there for said dwell interval and a second position for retracting the sealing member and said moving means is operable to move the pivot to its said second position on elapse of said predetermined time interval.

15. Apparatus for packaging units in individual sealed packages comprising:

means for continuously feeding forward a web of thermoformable plastic material and forming open-mouthed receptacles in the web with the receptacles spaced at intervals longitudinally of the web and with portions of the web surrounding the mouths of the receptacles for the sealing thereto of a cover web for forming sealed packages, said means being operable at one of different speeds;

units to be packaged being introduced into said receptacles;

means for continuously feeding a second web of thermoplastic material constituting a cover web into engagement with said portions of the first web for forward movement together with the first web;

a sealing member;

means for bringing the sealing member into engagement under pressure with the cover web to press it against said portions of the first web and heating said webs where pressed together for heat-sealing them together around the open mouths of the receptacles;

means for moving the sealing member forward at the speed at which the web is fed forward; and means for maintaining the sealing member in engagement with the webs for a timed sealing interval which is the same for the different speeds of the web and then withdrawing the sealing member from the webs.

16. Apparatus as set forth in claim 15 wherein the first web is fed forward in a predetermined path with the mouths of the receptacles directed downward, the second web is fed into engagement with the first, and the units to be packaged are fed forward on the second web for entry into the receptacles, the first web being fed forward at a speed as determined by the delivery of units for being fed forward on the second web.

* * * * *